United States Patent [19]

Tietz

[11] Patent Number: 4,653,298

[45] Date of Patent: Mar. 31, 1987

[54] LOCK-KEY SYSTEM

[75] Inventor: Werner Tietz, Berlin, Fed. Rep. of Germany

[73] Assignee: Zeiss Ikon AG, Fed. Rep. of Germany

[21] Appl. No.: 668,025

[22] Filed: Nov. 5, 1984

[30] Foreign Application Priority Data

Nov. 5, 1983 [DE] Fed. Rep. of Germany ..... 3340073

[51] Int. Cl.[4] ..... E05B 19/04

[52] U.S. Cl. ..... 70/406; 70/409; 70/411

[58] Field of Search ..... 70/405, 406, 346, 347, 70/409, 411

[56] References Cited

U.S. PATENT DOCUMENTS 4,168,617 9/1979 Prunbauer ..... 70/409
4,320,638 3/1982 Dunphry ..... 70/409
4,325,242 4/1982 Tietz .

FOREIGN PATENT DOCUMENTS 258614 4/1965 Australia ..... 70/406
88591 2/1960 Denmark ..... 70/406
1553522 4/1970 Fed. Rep. of Germany ..... 70/405
2817966 1/1979 Fed. Rep. of Germany ..... 70/406

*Primary Examiner*—Robert L. Wolfe

[57] ABSTRACT

A key for a lock-key system, particularly for a hierarchal lock system, is provided which has an invariable basic profile and a variation or system profile in which the invariable basic profile is allocated to the region of the key facing carrying the classification notches and has at least two profiled formations which cross the centerline of the key. The variation or system profile is allocated to the key region adjacent to the key spine. Variations are provided in the system profile by longitudinal incisions having a rectangular cross-section.

2 Claims, 4 Drawing Figures

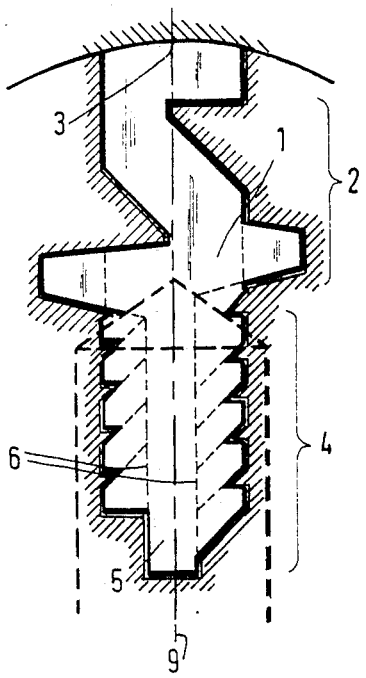
Fig.1
(PRIOR ART)
Fig.2
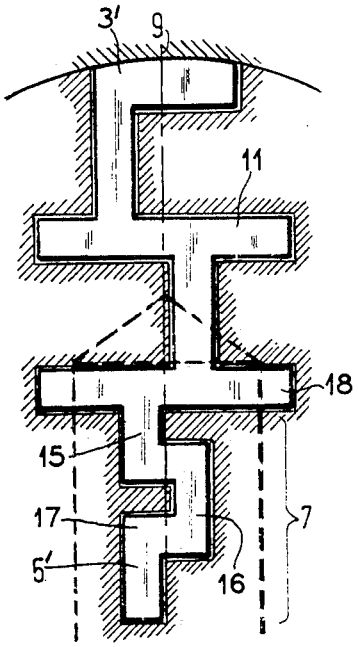
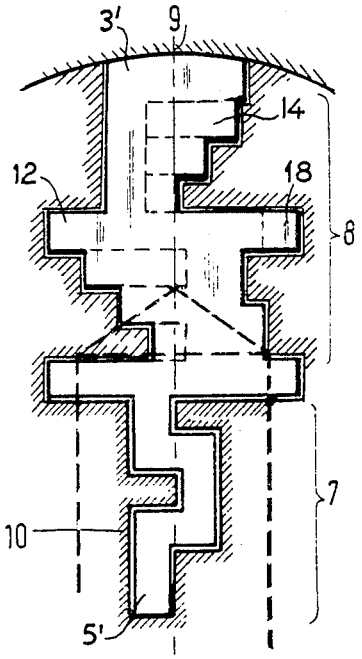
Fig.3

LOCK-KEY SYSTEM

BACKGROUND OF THE INVENTION

1. Field of the Invention

The invention relates to a lock-key system particularly in a hierarchal lock system, and more particularly to a configuration arrangement for a key.

2. Description of the Prior Art

Lock and key systems are well known wherein the variation or system profile used to differentiate between master keys and subordinate keys is allocated to the facing region of the key, that is, to the region which carries the classification notches, whereas the section adjacent to the spine of the key is provided with an invariable basic or guide profile. The disadvantage of these allocations of variation and invariable base profiles results from the fact that the key channel must be kept limited to a straight line and must have a minimum width precisely in the region of the tumblers, this opening up possibilities for the introduction and actuation of picking or sensing tools.

SUMMARY OF THE INVENTION

The present invention avoids the disadvantage described above by reversing the placement of the variation profile and the invariable basic profile. Thus, the invariable basic profile is allocated to the region of the key facing carrying the classification notches and thus providing this area with at least two profiled formations, that is a paracentric profile formation, which cross the centerline of the key. Also, the variation or system profile is moved into the section adjacent to the key spine.

The advantage achieved by such a rearrangement is that the key channel thus comprises a dentate design in the region of the basic profile section which largely prohibits access by picking tools, the consequence thereof being that security against picking is considerably enhanced.

BRIEF DESCRIPTION OF THE DRAWINGS

FIG. 1 is an end view of a prior art key.

FIG. 2 is an end view of a master key embodying the principles of the present invention.

FIG. 3 is an end view of a key subordinate to the key shown in FIG. 2.

DESCRIPTION OF THE PREFERRED EMBODIMENTS

Figure 4:
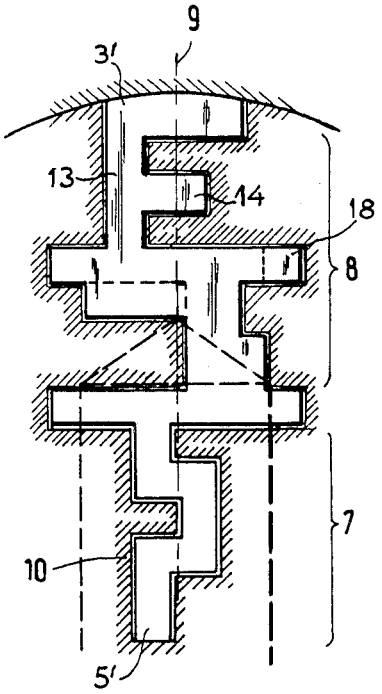
FIG. 4 is an end view of an additional key subordinate to the key shown in FIG. 2 which is supraordinate to the key shown in FIG. 3.

FIG. 1 shows an end view of a prior art key 1 in which a basic profile section 2 is allocated to the section adjacent to a key spine 3 and a variation profile 4 is allocated to the section adjacent to a key facing 5 provided with the classification notches. Possible profile variations are indicated in FIG. 1 by dotted lines and it is evident that the key channel must at least comprise an opening 6 limited by a straight line in its basic shape in the region of the variation profile and having a minimum width, the straight line lying generally along a centerline 9 of the key 1.

A key 11 embodying the principles of the present invention is shown in FIGS. 2–4 which is quite distinct from the prior art key 1 in that an invariable basic profile 7 is now positioned in a key facing section 5' containing the classification notches, and a system or variation profile 8 is in a section of the key 11 close to a spine 3' of the key. The variation profile area 8 can extend from the spine 3' to the middle part of the key 11.

FIGS. 3 and 4 each show a key 12, 13 having many possible formations of the variation profile. Specifically a plurality of protrusions or elevations 14 are provided along the part of the keys 12, 13 just below the spine 3'. The key 13 of FIG. 4 has some of the same protrusions 14 as the key 12 of FIG. 3, but not all of them. Key 13 may also be viewed as having more incisions than key 12, that is, a lack of protrusions being equated with an increase in incisions. Thus, key 12 is subordinate to key 13 in a hierarchal lock system in that key 13 will fit into all locks which can receive key 12 and then some. There are no locks which will receive key 12 but not key 13. Key 11 is a master key over both keys 12 and 13 since all of the protrusions 14 have been removed. Thus, key 11 is a higher order key, the hierachy and can fit into every lock which can receive key 13 or key 12 as well as others.

Common to each of the keys, however, is that they carry a basic profile 7 in the lower section, namely that of the key facing 5'. The basic profile 7, as shown in the illustrative embodiments, consists of a paracentric which crosses the center line 9 at 3 points indicated at points 15, 16 and 17. A key channel 10 in the lock which receives the basic profile 7 thus has a dentate course which largely prevents work with lock-picking tools.

An additional feature of the key which enhances the security against unauthorized opening of the lock is that the key contains at least one safety rib profile 18, that is, a profile that projects beyond the case or flat side of the key so that reworking of the key can only occur by means of applying additional material. Four safety ribs 14 are shown in the embodiments of FIGS. 2 through 4.

It is quite advantageous to fabricate the profile incisions and elevations 14 with a rectangular cross-section as is shown in the figures. This enables an economic manufacture of the keys and, as a consequence thereof, a multitude of variations can be undertaken because a very slight width of the profile incisions can be produced, for example, by means of milling disks. Applicant has found that incisions which have a width of 0.6 millimeters can be incorporated in keys with surprising success. Thus, a large number of incisions can be made along the height of the key as is shown in the figures resulting in a large available variation in a multiple lock system.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A lock-key system, particularly for hierarchal lock systems, wherein the keys are provided with an invariable basic profile and with a variation profile comprising the improvement of:

said invariable basic profile being contained in the region of a key facing carrying a plurality of classification notches and being provided with at least two profile formations which cross the centerline of the key;

said variation profile being positioned only in that section adjacent to the key spine;

said variation profile including at least one safety rib profile projecting beyond a lateral face of the key; and said basic profile and variation profile being comprised of profile incisions which have a rectangular cross-section;

whereby the lock is protected against the use of lock-picking tools by incorporating the basic profile in the region of the key facing with the profile formations crossing the centerline of the key.

2. A lock-key system, particularly for hierarchal lock systems, wherein the keys are provided with an invariable basic profile and with a variation profile comprising the improvement of:

said invariable basic profile being contained in the region of a key facing carrying a plurality of classification notches and being provided with at least two profile formations which cross the centerline of the key;

said variation profile being positioned only in that section adjacent to the key spine;

said variation profile including at least one safety rib profile projecting beyond a lateral face of the key; and said basic profile and variation profile being comprised of profile incisions which have a rectangular cross-section with a width of 0.6 millimeters;

whereby said keys can be economically manufactured by use of milling disks.

* * * * *